US005091116A

United States Patent [19]

Krishnamurthy et al.

[11] Patent Number: 5,091,116

[45] Date of Patent: Feb. 25, 1992

[54] METHODS FOR TREATMENT OF EDIBLE OILS

[75] Inventors: R. G. Krishnamurthy, Glenview; Neil R. Widlak; Joel J. Wang, both of Northbrook, all of Ill.

[73] Assignee: Kraft General Foods, Inc., Glenview, Ill.

[21] Appl. No.: 677,380

[22] Filed: Mar. 27, 1991

Related U.S. Application Data

[63] Continuation of Ser. No. 935,642, Nov. 26, 1986, abandoned, which is a continuation of Ser. No. 579,385, Feb. 13, 1984, abandoned.

[51] Int. Cl.[5] ..... C11B 3/14; C11B 3/00

[52] U.S. Cl. ..... 260/409; 260/420; 260/428; 260/419; 426/313; 426/417; 426/488; 426/486; 426/487

[58] Field of Search ..... 260/409, 420, 428, 419; 426/313, 417, 488

[56] References Cited

U.S. PATENT DOCUMENTS

| | | | |
|---|---|---|---|
| 1,260,072 | 3/1918 | Schuck | 260/409 |
| 2,021,552 | 9/1935 | Hildisch | 87/12 |
| 2,282,791 | 8/1942 | Musher | 260/428 |
| 2,311,633 | 2/1943 | Blaso | 260/420 |
| 2,353,229 | 7/1944 | Durkee | 260/409 |
| 2,428,082 | 9/1947 | King et al. | 260/428 |
| 2,521,602 | 9/1950 | Potts et al. | 260/409 |
| 2,559,129 | 7/1951 | Miller | 426/488 |
| 2,613,215 | 10/1952 | Mattil | 260/409 |
| 2,717,202 | 9/1955 | Bailey | 23/283 |
| 3,218,048 | 11/1965 | Smith et al. | 261/94 |
| 3,933,953 | 1/1976 | Leva | 426/488 |
| 3,969,382 | 7/1976 | Zosel | 260/409 |
| 4,789,554 | 12/1988 | Scavone et al. | 260/420 X |

FOREIGN PATENT DOCUMENTS 1112237 8/1961 Fed. Rep. of Germany .

OTHER PUBLICATIONS

Kirk-Othmer, *Encyclopedia of Chemical Technology*, John Wiley & Sons, Inc., 1967, vol. 13, p. 181.

*Primary Examiner*—Carolyn Elmore

*Attorney, Agent, or Firm*—Fitch, Even, Tabin & Flannery

[57] ABSTRACT

Improved methods for treatment of edible oils such as soybean oil and cottonseed oil to improve its stability, flavor and/or to deodorize the oil.

9 Claims, 4 Drawing Sheets

Figure 1:
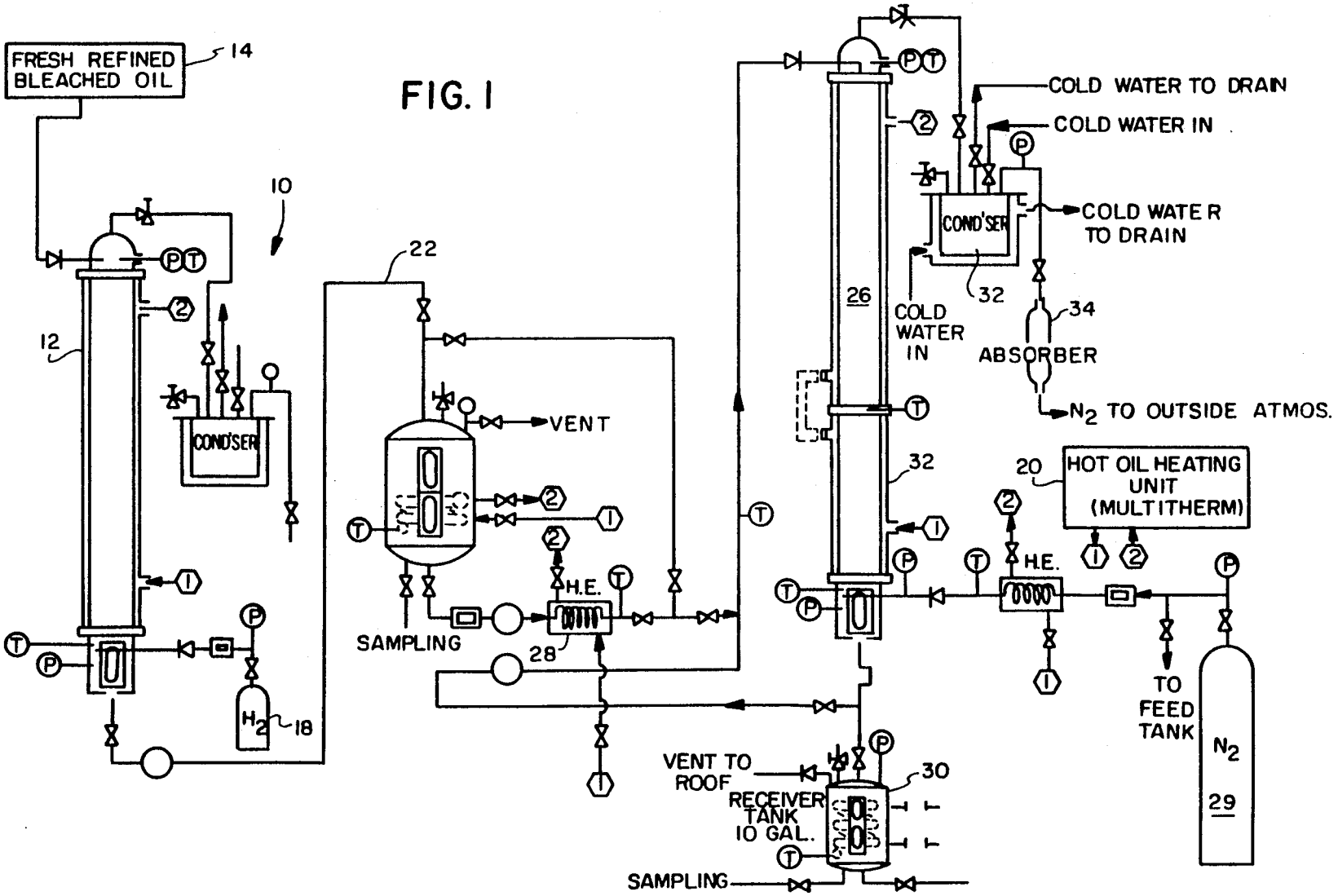

OIL LOADING RATE : 570 LBS/HR/FT2
FREE FATTY ACIDS REMOVED (%)
90
80
70
60
50
40
30
20
10
500°F
475°F
450°F
425°F
2
4
6
8
10
12
G/L RATIO (FT3 N2/LBS OIL)

REFINED S/B # 60934
86
BLEACH
REF, BL, S/B
88
LOW H2 TREAT
REF, BL, LOW H2 TREAT
92
BLEACH
REF, BL, LOW H2 TREAT, BL
94
N2 DEOD
STEAM DEOD
REF, BL, LOW H2 TREAT BL N2 DEOD
98
REF, BL, LOW H2 TREAT BL STEAM DEOD
96
STEAM DEOD
REF, BL STEAM DEOD
90

METHODS FOR TREATMENT OF EDIBLE OILS

This application is a continuation of application Ser. No. 935,642, filed Nov. 26, 1986, now abandoned, which is a continuation of application Ser. No. 579,385, filed Feb. 13, 1984, now abandoned.

The present invention is directed to the treatment of vegetable oils, and more particularly, is directed to methods for deodorizing and stabilizing edible oils such as soybean oil which contain relatively strong and unpalatable flavor components.

Conventionally, edible oils including vegetable oils, such as soybean oil which have a characteristically offensive beany flavor, are refined by alkali treatment, bleached, and subjected to a deodorization treatment by means of steam injection into a hot oil mass under substantial vacuum. Conventional vacuum-steam deodorization processes utilize volatility differences between the vegetable oil triglycerides and the undesired flavor components to strip the relatively more volatile flavor components from the relatively less volatile triglycerides. Although they have not been fully characterized, many of the compounds responsible for undesirable vegetable oil taste and odors which are conventionally removed by deodorization have been identified as ketones, aldehydes and alcohols having very low flavor threshold concentrations. Other undesirable materials such as pesticides and fatty acids may also be removed by such treatment. Vacuum-steam deodorization treatment also decomposes peroxides in the oils and removes the other volatile products which may result from such decomposition.

The amount of odoriferous compounds required to be removed in deodorizing an edible oil is small, and rarely, if ever, exceeds 0.1% of the weight of the oil. However, conventional practice of steam deodorization results in removal of other materials such as fatty acids, including fatty acids initially present and fatty acids formed by hydrolysis interaction with steam during deodorization, which together with loss attributable to mechanical entrainment of the oil in the vacuumized stripping steam, may make the total loss considerably greater. The free fatty acids in an oil have vapor pressures of the order of 5–50 millimeters of mercury at deodorizing temperatures, and consequently the free fatty acids in an oil are almost completely removed by steam deodorization treatments.

Because the steam requirements for vacuum-steam deodorization are generally inversely proportional to the vapor pressure of the pure volatile components of the oil at operating temperature, for economical operation the stripping is carried out at as high a vacuum as practically possible, and vacuum conditions of six millimeters of mercury or less are readily obtained with three-stage steam ejector equipment in respect to steam deodorization processing. The amount of steam required for operation of the vacuumizing ejectors is generally several times the amount of stripping steam, and all of this steam should be condensed. Hence, steam and cooling water requirements for steam deodorizing of vegetable oils are substantial, and there is a need for methods for deodorizing oils in a more energy-efficient manner.

Accordingly, it is an object of the present invention to provide more energy-efficient methods for effecting deodorization of edible oils, and to provide a stable oil product. It is a further object of the present invention to provide methods for treating edible oils such as soybean oil to remove or inactivate undesirable odors and flavors.

Figure 2:
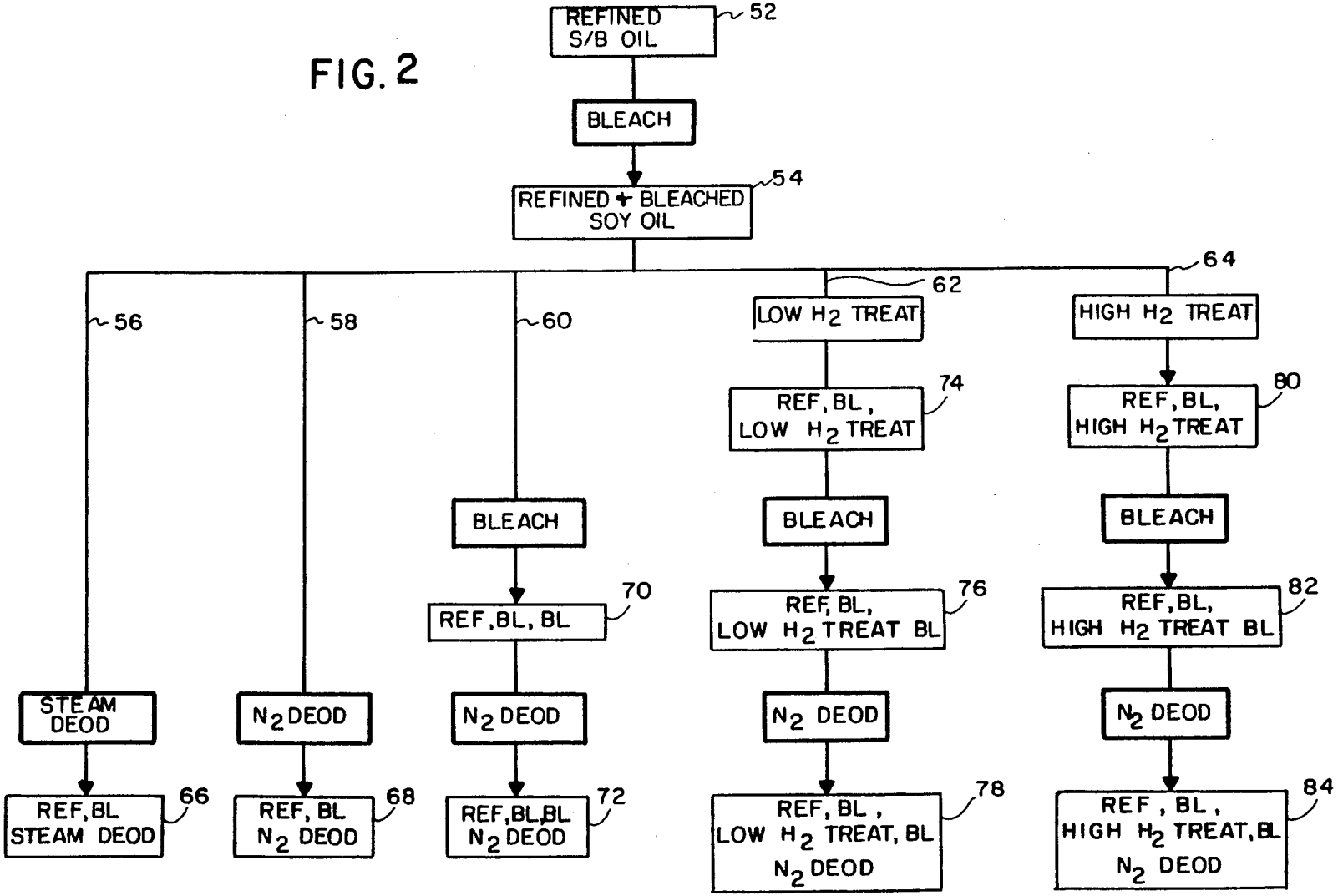
Figures 3, 5:
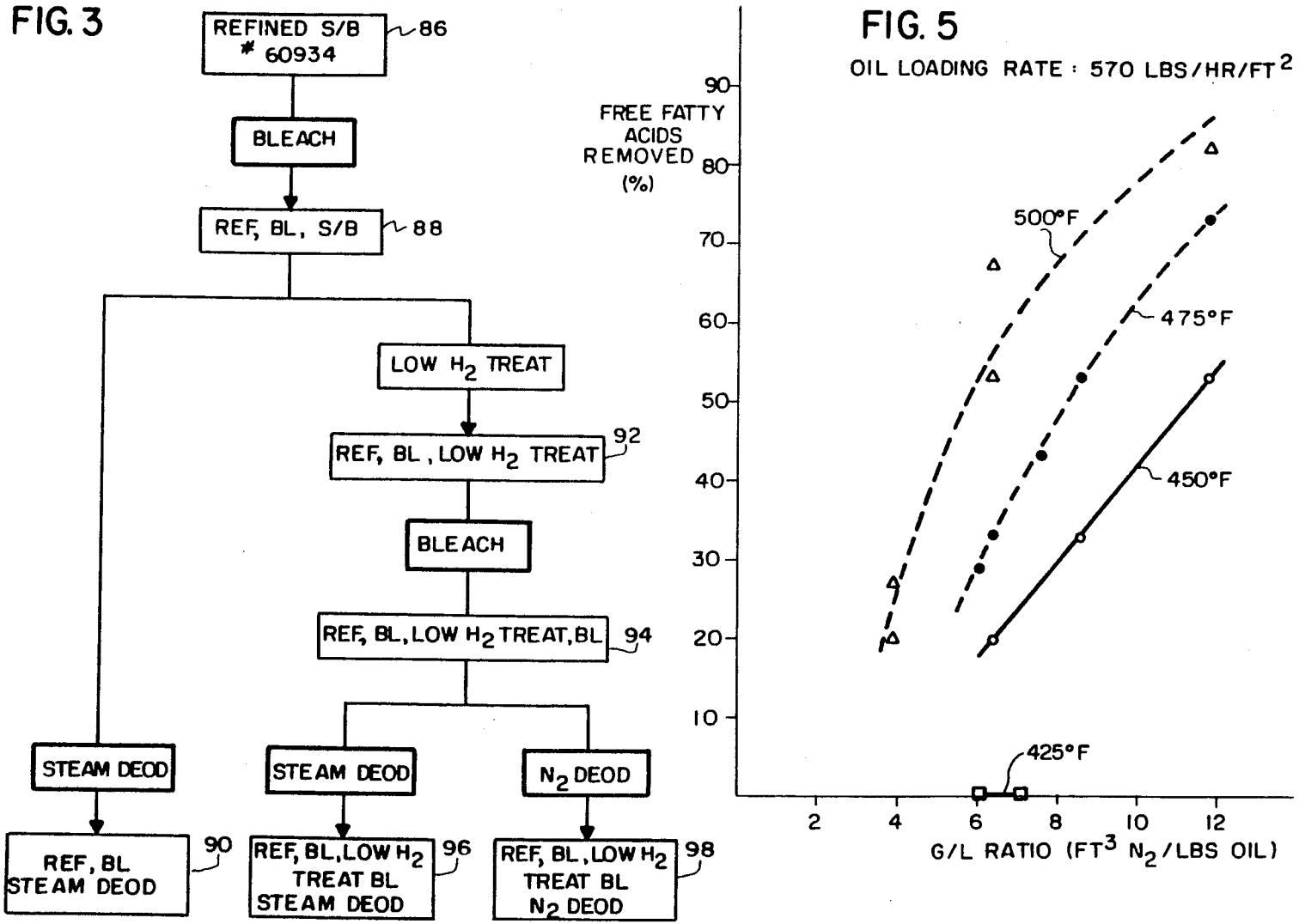
Figure 4:
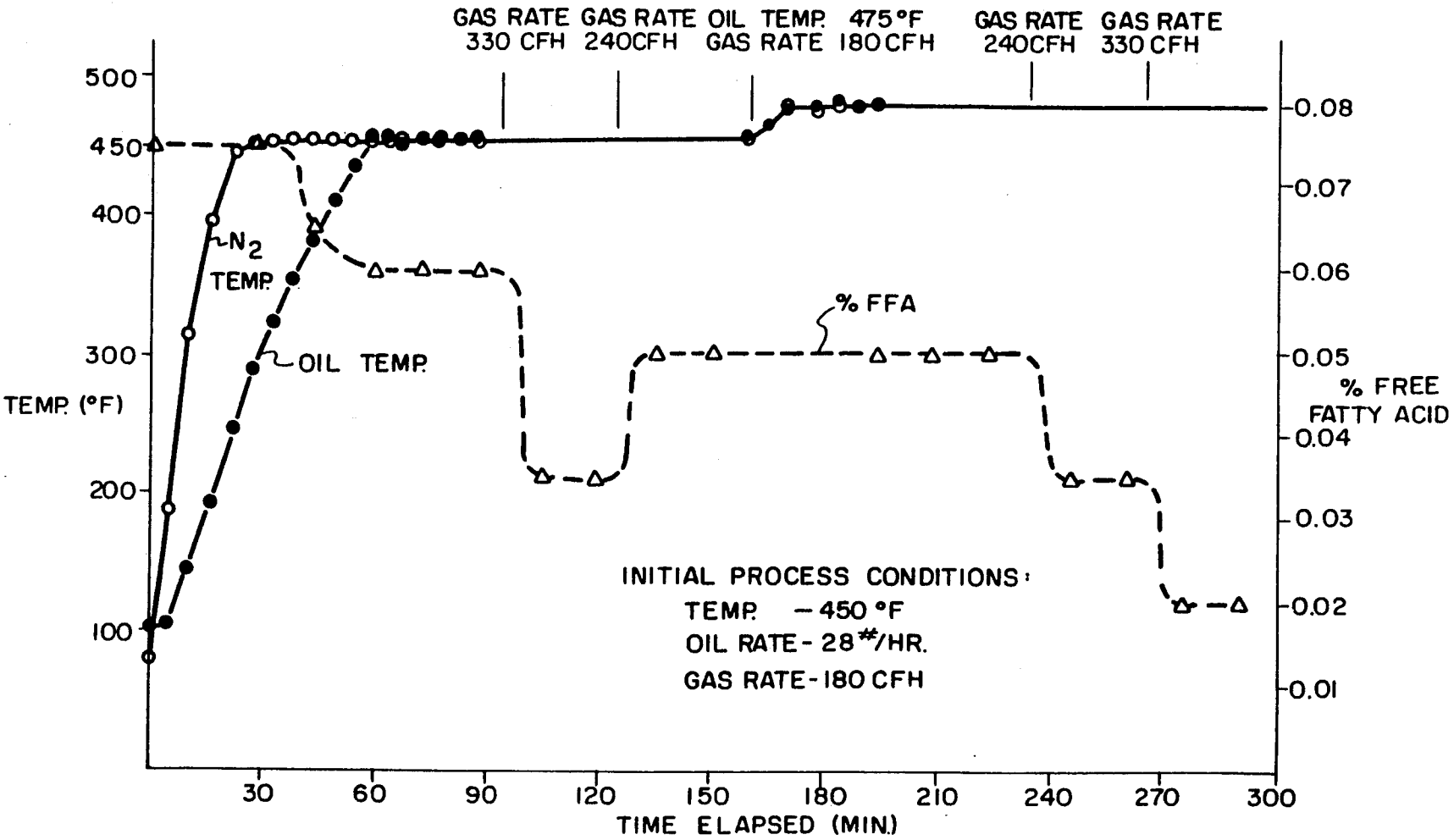

These and other objects of the invention will become more apparent from the following detailed description and the accompanying drawings, of which FIG. 1 is a schematic illustration of pilot scale process equipment utilized in connection with an embodiment of the present invention, FIG. 2 is a process flow chart illustrating various oil processing conditions in a comparative series of process runs, FIG. 3 is a process flow chart illustrating various additional oil processing conditions in another comparative series of processing runs, FIG. 4 is a graphical representation of process conditions and free fatty acid product analysis over an extended time period, and FIG. 5 is a graphical representation of free fatty acid removal as a function of processing conditions at a number of different processing temperatures.

Generally in accordance with various aspects of the present invention, methods for deodorizing edible oils are provided which may be applied to the treatment of a wide variety of undeodorized oils. Various additional aspects of the present disclosure may be specifically applied to the processing and deodorization of edible oils from vegetables and/or animal sources. The methods have particular applicability to vegetable oils including oleic-linoleic acid oils and linolenic acid oils such as cottonseed oil, peanut oil, sesame seed oil, corn oil, soybean oil and safflower oil and other edible oilseed oils, and mixtures thereof. Various aspects of the method may also be applied to deodorization of edible oils of animal origin such as lard and tallow.

Methods in accordance with various aspects of the present disclosure comprise the steps of deoxygenating the oil, heating the oil to a temperature in the range of from about 350° F. to about 540° F. and continuously contacting the heated oil with nitrogen under at least substantially atmospheric pressure conditions for a time period of at least about 5 minutes. It may be desirable to periodically increase and decrease the pressure at which the nitrogen is introduced. By means of such pressure modulation, if desired, increased deodorization efficiency may be obtained. The pressure modulation may desirably be in the range of from about 1 psig to about 100 psig, and preferably in the range of from about 20 psig to about 100 psig.

It is important that the nitrogen utilized be substantially oxygen free, and that the oil be deoxygenated prior to being heated to deodorization temperature. The oil may desirably be an oil which has been subjected to hydrogen reduction conditions without substantially reducing the unsaturated fatty acid triglyceride content of the oil, as will be described in more detail hereinafter.

As indicated, in accordance with various additional aspects of the present invention, methods for treating unsaturated edible oils such as soybean oil are provided which comprise the steps of deoxygenating the oil, subjecting the oil to hydrogen reduction conditions in the presence of hydrogen and a hydrogenation catalyst without substantially reducing the unsaturated fatty acid triglyceride content of the oil. Accordingly, the oil is subjected to a chemical reduction potential for the limited purpose of reducing undesirable oil components, under conditions of reaction limitation which do not permit substantial hydrogenation of the unsaturated fatty acid moieties of the oil. In this regard, the hydrogen reduction should be carried out such that the decrease of the iodine value (I.V.) of the oil during the course of the hydrogenation is on the order of about one or less. In this regard, the percentage reduction of the unsaturated bonds of the triglyceride components of the vegetable oil should best be in the range of from about 1.3 to about 0.3%. The reduction contemplated by the disclosure is sufficiently low that it is at the lower limit of conventional analytical techniques to measure accurately. The hydrogen reduction may be carried out using relatively low hydrogenation pressures, with atmospheric pressure hydrogenation conditions being particularly desirable in which the partial pressure of the hydrogen is about 1 atmosphere or less. The hydrogen reduction may be further controlled by limiting the concentration of hydrogen catalysts in the vegetable oil during its contact with hydrogen at hydrogenation temperature, by selecting the catalytic activity of the catalyst and by controlling the hydrogenation temperature of the oil. It is believed that such hydrogenation conditions may reduce unstable or otherwise undesirable components such as undesirable peroxides, ketones, aldehydes and other unsaturated oxidized fatty acids or glycerides.

Various additional aspects of the present invention will now be described with particular reference to the specific embodiment of a deodorization method employed in connection with the apparatus 10 illustrated in FIG. 1 of the drawings.

Shown in FIG. 1 is hydrogenation and deodorization apparatus 10 which may be utilized in carrying out various features of the present invention. In this regard, the apparatus 10 comprises a hydrogenation vessel 12 containing an appropriate fixed catalyst bed, into which fresh, refined bleached soybean oil 14 may be introduced. The hydrogenation vessel 12 is provided with appropriate means for temperature control of the contents of the vessel, which in the illustrated embodiment comprises a jacket to which may be provided a heating fluid from heating unit 20 by means of the illustrated inlet and outlet ports 1, 2. The hydrogenation vessel 12 is also provided with means for introducing hydrogen gas from a suitable hydrogen source 18 which in the illustrated embodiment is high purity hydrogen having a purity of at least about 99.995 weight percent and less than about 5.0 ppm oxygen. The hydrogen 18 is introduced at the bottom of the vessel 12 by means of a suitable hydrogen sparging head at a pressure which is only slightly in excess of the pressure head of the vegetable oil at the point of introduction, and accordingly, the illustrated hydrogenation vessel need not be adapted for high pressure hydrogenation conditions.

In the hydrogenation vessel 12, the vegetable oil 14 is contacted with catalyst and hydrogen under very mild reduction conditions at a temperature in the range of from about 100° F. to about 375° F., preferably 225° to 325° F. The hydrogen is introduced at a rate sufficient to maintain hydrogen dissolved in the oil under substantially saturated conditions of dissolution at atmospheric pressure. The catalyst employed may be selected from conventional, nickel, palladium or platinum catalysts on a suitable support. Alternatively, a suitable catalyst may be metered into the hydrogenation reactor with the oil and subsequently filtered from the oil. It is important that the effective hydrogenation rate be relatively slow, such that the vegetable oil 14 in the vessel 12 is substantially unaffected by the hydrogenation conditions. In this regard, the iodine value (I.V.) of the triglycerides should be reduced by about one or less, and preferably less than 1 in its hydrogenation treatment. It is believed that undesirable flavor component materials and precursors are selectively hydrogenated by this treatment, and it is the purpose of this treatment to hydrogenate selectively non-triglyceride components of the oil, while leaving the natural unsaturated triglyceride oil components substantially unaffected. In this regard, substantially all of the soybean oil 14 as naturally obtained has substantially all cis unsaturation. Conjugated acids (including their glyceride esters), to the extent there is any hydrogenation of the oil, would be first selectively hydrogenated. The soybean oil after hydrogenation treatment will not substantially increase in its trans acid content, and will have an iodine value which is substantially the same as that of the soybean oil source material 14.

Although the indicated hydrogenation vessel 12 is a continuous hydrogenation vessel, it will be appreciated that batch hydrogenation equipment ma be utilized which carries out very limited hydrogenation treatment in accordance with the present invention. A catalyst may be dispersed in the source oil in the vessel 12. Following completion of the hydrogen treatment the oil containing the catalyst may be pumped through a filter where the catalyst is removed from the treated oil stream.

The lightly hydrogenated vegetable oil stream 22 from the continuous hydrogenation treatment zone 12 is introduced into a surge tank 24. It will be appreciated that the treated oil stream 22 has been substantially deaerated, and has an oxygen content of substantially zero. It is important that the stream 22 not be contacted with air, and in this regard, the tank 24 is maintained under nitrogen blanket from an appropriate nitrogen source having less than five parts per million oxygen and preferably less than one part per million (weight) oxygen concentration. Appropriate samples may be taken of the treated stream 22 from the tank 24 for analysis by means of appropriate sampling ports, and the oil may be maintained at a desired temperature by means of appropriate heating fluid from an appropriate heating unit, as indicated in the drawing.

Further in accordance with the illustrated method embodiment, the treated oil, which is continuously excluded from contact with oxygen, is passed into a deodorization tower 26. The oil may be preheated by passage through a heat exchanger 28 which is similarly provided with heat input from heating unit 20.

The deodorization vessel 26 into which the soy oil 22 is introduced, may be a column having a length to diameter ratio of at least about 3, and preferably at least about 20. The illustrated column 26 has a length to diameter ratio of about 40, which is provided with a column packing having a surface area of at least about 30 square feet per cubic foot of treatment zone volume, and preferably at least about 500 square feet per cubic foot. A particularly preferred packing in the form of a coiled metallic screen has a surface area to volume ratio of about 585 square feet per cubic foot.

As indicated, the oil 22 should be substantially completely deoxygenated, and in this regard, should have a dissolved molecular oxygen content of less than about 1 ppm. At the high temperatures used for deodorization, reaction of the oil with atmospheric oxygen is very rapid. Any such oxidation adversely affects the stability of the oil and its flavor. Moreover, because oil exposed to the atmosphere will dissolve an appreciable amount of air, the feed oil should be substantially completely deaerated before it is heated to deodorization temperature. If the oil has an undesirably high oxygen content, it should be vacuum deaerated or purged by means of an inert gas at a relatively low temperature (e.g., a temperature of less than about 140° F., and preferably in the range of from 70° F. to 140° F.) to reduce the oxygen content thereof to the desired level before the oil is heated to higher temperature which can produce oxidized flavors. An oxygen containing oil may be introduced into an appropriately designed column which provides for removal of oxygen as it passes through the column at a relatively low temperature followed by progressive heating of the oil to deodorization temperature.

However, as indicated, the hydrogen-treated oil 22 which is maintained under a nitrogen blanket is substantially free of oxygen, and may be introduced into the column 26 at an elevated temperature. The column 26 is provided with a thermal jacket into which may be introduced hot oil from the heating unit 20 to maintain the oil 22 therein at a predetermined temperature. In this regard, the oil 22 in the deodorizing column 26 should be heated to a temperature in the range of from about 325° F. to about 550° F. while being subjected to an inert gas purge at atmospheric pressure or slightly superatmospheric pressure. In this regard in the illustrated embodiment 10, nitrogen gas from a source 29, which is substantially pure, having less than about 1 part per million of oxygen, by weight, is introduced into the bottom of the deodorization column 26 by means of a sparging head comprising a fine wire mesh covered orifice adapted to disperse the nitrogen in fine bubbles into the oil 22. The nitrogen is introduced into the oil at a pressure in the range of from about 1 to about 10 pounds per square inch above the gauge pressure (representing the liquid head at the point of introduction), to provide a corresponding nitrogen flow rate in the range of from about 14 to about 330 standard cubic feet per hour. The column packing, which may be in the form of stainless steel mesh wire, rings or other suitable inert materials such as porcelain, provides a substantially increased surface area for interaction of the nitrogen purging gas with the heated oil 22 in the deodorization column 26. The illustrated column 26 is a continuous process treatment column having an internal volume of about 0.5 cubic feet, a diameter of 3 inches and a height of 10 feet. The oil 22 may be pumped into the column at the top thereof at a rate in the range of from about 2 to about 24 or more pounds per hour and is concomitantly withdrawn at the bottom of the column into recovery tank 30 at a substantially equivalent rate. In order to prevent channelling of oil along the sides of the column, wall wipers (rings) 32 adapted to direct flow from the walls adjacent the column into the interior of the column may be provided periodically along the column 26 when appropriate. However, such wall wipers are unnecessary for use with the preferred coiled screen packing which evenly disperses the oil and gas and substantially prevents channelling within the column.

In this manner, a substantially uniform flow front is provided in the column 26 for countercurrent sparging of the hydrogen-treated oil 22 introduced therethrough.

As indicated, the nitrogen is introduced at slightly superatmospheric pressure, and is introduced at a rate which is effective to achieve deodorization of the oil in less than about two hours and preferably less than about 30 minutes of treatment time. In this regard, nitrogen may be introduced at a flow rate which provides an oil to gas weight to weight ratio in the range of from about 1.2 to about 4.5. The nitrogen gas emerges from the top of the column, which is provided with suitable screens and baffles to minimize entrainment of triglyceride oils in the nitrogen, and is conducted from the deodorization tower through a condenser 32 which functions to condense the vaporized materials carried therewith. The nitrogen may be passed from the condenser to the absorber, which may be an activated carbon absorber 34 and vented to the outside atmosphere, or utilized for recycled application through the deodorizing column 26.

The oil 22 is subjected to an average residence time within the column 26 of at least about 5 minutes, and typically in the range of from about 10 to about 30 minutes. The residence time to achieve deodorization will generally decrease with decreasing oil to gas treatment weight ratio under the indicated treatment conditions, and is subsequently conducted to the receiving tank 30. The oil in the tank 30 may be cooled to ambient temperature, and should be maintained in an oxygen free environment such as provided by a nitrogen blanket as previously described.

The oil and the oil the receiving tank 30 may be sampled by means of an appropriate sampling port, and the oil is found to have a bland taste and the oil aroma. Shelf life tests conducted on the oil indicate excellent keeping qualities for the oil.

From about 0.1 to about 0.3 weight percent based on the weight of the incoming oil 22, is collected in the condenser 32. The material collected in the condenser 32 includes a substantial proportion of pesticides which may have been present in the oil, various undesirable flavor and taste components, free fatty acids and tocopherol components.

After deodorization is completed, the oil is cooled before it is discharged. It is desirable not to expose the deodorized oil to the atmosphere and preferably the oil will be discharged to nitrogen blanketed tanks.

Additional runs are carried out utilizing a refined and bleached soybean oil from a commercial refinery. In one run, the oil is subjected to conventional steam deodorization (e.g., at about 0.5 mm of mercury vacuum, a temperature of 500° F., and 4% water as stripping steam). A second sample of the refined and bleached soybean oil is subjected to nitrogen deodorization at pilot plant scale in apparatus of the type illustrated in FIG. 1, in which the refined and bleached soybean oil is pumped through a heat exchanger, heated to 450° F. to the top of the 10 foot tall, 3 inch diameter column (jacketed and heated to 450° F.) which is filled with wound screen distillation packing material sold by Glitsch Inc. under the designation Goodloe. The oil is allowed to pass through the column by gravity, while a counter current of zero grade nitrogen is passed through the column from the bottom and exit through the top, at an oil flow of 4.0 liters oil per hour and a nitrogen gas flow of 14 cubic feet per hour. The deodorized oil emerging from the bottom of the column is collected and cooled in a separate receiving tank.

Analytical properties of the steam and nitrogen deodorized oils are as follows:

TABLE 1

| | Ref. & Bl. Starting Oil | Steam Deodorized | Nitrogen Deodorized |
|---|---|---|---|
| Red Color | 5.4 | 1.0 | 0.8 |
| Iodine Value | 133.5 | 131.4 | 132.9 |
| Conj. Dienes | 1.91 | 5.88 | 3.64 |
| Cong. Trienes | 1.29 | 1.23 | 1.23 |
| Total Tocopherols | 0.1244 | 0.0709 | 0.1210 |
| % Trans Isomers | 0 | 1.0 | 0 |
| Flavor Score | — | 5.3 | 5.0 |
| % FFA | .08 | 0.03 | 0.09 |
| P.V. | 1.6 | Nil | Nil |

Data illustrating the variation of oil processing rate, nitrogen gas introduction rate and oil temperature, and effect on free fatty acid removal are as follows.

TABLE 2

| Oil Rate Lbs/Hr | Gas Rate Ft3/Hr | Oil Temp. °F. | FT3N2 Lb. Oil | FFA Conc. %* | % FFA Removed |
|---|---|---|---|---|---|
| 20.8 | 68 | 450 | 3.4 | 0.075 | 0 |
| 28.0 | 57 | 425 | 2.0 | 0.075 | 0 |
| 28.0 | 171 | 425 | 6.1 | 0.070 | 6 |
| 20.8 | 68 | 450 | 3.3 | 0.075 | 0 |
| 14.5 | 34 | 425 | 2.3 | 0.075 | 0 |
| 20.8 | 68 | 450 | 3.1 | 0.075 | 0 |
| 14.5 | 103 | 425 | 7.1 | 0.075 | 0 |
| 14.5 | 34 | 475 | 2.3 | 0.075 | 0 |
| 28.0 | 57 | 475 | 2.0 | 0.075 | 0 |
| 20.8 | 68 | 450 | 3.3 | 0.070 | 0 |
| 28.0 | 171 | 475 | 6.1 | 0.050 | 29 |
| 28.0 | 103 | 475 | 3.7 | 0.075 | 0 |
| 28.0 | 215 | 475 | 7.6 | 0.040 | 43 |
| 28.0 | 330 | 500 | 11.8 | 0.015 | 82 |
| 28.0 | 180 | 500 | 6.4 | 0.025 | 67 |
| 28.0 | 108 | 500 | 3.9 | 0.060 | 20 |
| 28.0 | 180 | 450 | 6.4 | 0.060 | 20 |
| 28.0 | 240 | 450 | 8.6 | 0.050 | 33 |
| 28.0 | 330 | 450 | 11.8 | 0.035 | 53 |
| 28.0 | 180 | 475 | 6.4 | 0.050 | 33 |
| 28.0 | 240 | 475 | 8.6 | 0.035 | 53 |
| 28.0 | 330 | 475 | 11.8 | 0.020 | 73 |

*Assay data before filtration

Illustrated in FIG. 4 is a graphical representation of various of the operating parameters for 5 hours of a continuous run utilizing the continuous counterflow treatment column 26. As shown in FIG. 4, startup process conditions of 450° F. soybean oil temperature, at an oil flow rate of 28 pounds per hour and an initial nitrogen flow rate of 180 standard cubic feet per hour were attained in about 60 minutes. Variations of nitrogen flow rate and oil processing temperature in respect to free fatty acid removal are shown by the FIGURE. Free fatty acid removal (as a percentage of the originally present fatty acid) is shown in FIG. 5 as a function of the nitrogen to soybean oil feed ratio G/L, in standard cubic feet of gas to pounds of oil, for operating temperatures of 425° F., 450° F., 475° F. and 500° F.

Turning now to FIG. 2, various aspects of the present invention will now be further described with respect to the processing flowchart illustrated in block diagram form in FIG. 2. As illustrated in FIG. 2, a conventional refined soybean oil 52 is bleached in accordance with conventional processing to provide a refined and bleached soy oil 54. Different aliquots 56, 58, 60, 62, 64 of the refined and bleached soy oil 54 are subsequently subjected to various processing conditions as illustrated in FIG. 2, to compare processing methods in accordance with the present invention with conventional processing techniques. In this regard, aliquot 56 is subjected to conventional steam deodorization conditions to provide a refined and bleached steam deodorized oil 66 by placing 2500 g. of the oil in a 5 liter standard deodorization flask with one sparge tube together with 25 ml of 1% citric acid in absolute ethanol (100 ppm citric acid to oil) prior to deodorization. Deodorization is carried out at a vacuum of 0.02 mm Hg. To deodorize the oil, steam is sparged through the vacuumized oil while it is heated to 525° F. over a time period of 50 minutes. The oil is then held at 525° F. for 70 minutes under the vacuum conditions and cooled with steam sparging to 80° F. for 60 minutes while maintaining the vacuum conditions. There is a sparge oil loss of about 0.50 weight percent, based on the weight of the starting oil material, it being noted that the laboratory glassware system utilized has low sparge oil recovery system. The weight ratio of sparge steam to oil is 2.43%.

A second aliquot 58 of the oil 54 is subjected to nitrogen deodorization treatment to provide a refined and bleached nitrogen deodorized oil 68. The nitrogen deodorization processing is carried out by placing 5000 grams of oil in a 40×15 cm rounded bottom glass reaction vessel having 3 fritted glass sparge tubes, and adding thereto 50 ml of 1% citric acid in absolute ethanol (100 ppm citric acid to oil) to the oil prior to deodorization. To carry out the deodorization, the oil is heated to 450° F. over a period of about one hour while sparging substantially pure (less than 5 ppm oxygen) nitrogen through the oil at a rate of 14.0 l/min. The oil is held at 450° F. for 3 hours under the nitrogen sparge, and is then cooled to 80° F. over a period of 1.5 hours under the nitrogen sparge at the 14 liter/minute rate.

A third aliquot of the oil 60 is subjected to a second bleaching step to provide a refined, double-bleached soybean oil 70. The double-bleached oil 70 is subjected to nitrogen deodorization conditions as previously described in respect to aliquot 58 to produce a refined, double-bleached nitrogen deodorized oil 72.

A fourth aliquot of 3000 grams of the oil 62 is subjected to low hydrogenation treatment to provide a low hydrogenation treated oil 74 under conditions which do not result in substantial hydrogenation of the unsaturated fatty acid moieties of the oil. In this regard, the oil is mixed with 0.05% weight percent, based on the weight of the oil, of a standard nickel hydrogenation catalyst, and is heated to 250° F. under substantially pure nitrogen sparge. The nitrogen sparge is discontinued upon reaching the 250° F. temperature, and substantially pure hydrogen (less than 5 ppm oxygen) is introduced at a rate of 7.0 l/min for 15 minutes. The hydrogen introduction is then discontinued and the nitrogen sparge is reinstated while the oil is cooled to 190° F. The oil is filtered through a bed of Filtercel. Hydrogenation treatment is carried out at atmospheric pressure. The hydrogen-reduced oil is subjected to a second bleaching step as previously described in connection with the refined soybean oil 52, to produce a refined hydrogen-reduced oil 76. The oil 76 is subjected to nitrogen deodorization treatment as previously described in connection with aliquot 58, to provide a hydrogen-reduced, nitrogen-deodorized oil 78.

A fifth aliquot of 3000 grams of the oil 54 is subjected to hydrogenation under conditions which result in sufficient hydrogenation of the unsaturated bonds of the unsaturated fatty acid moieties of the oil to cause a drop in the iodine value of the oil of about 4. In carrying out the hydrogenation step, 0.20 weight percent, based on the weight of the oil of a standard nickel hydrogenation catalyst is mixed with the oil. During a 45 minute time period, the mixture is heated to 350° F. under 7.0 l/min sparge of substantially pure hydrogen at atmospheric pressure. The oil is immediately cooled under the hydrogen sparge to 190° F. for 30 minutes and filtered through a bed of Filtercel to provide a hydrogenated oil 80. The oil 80, is in turn subjected to a second bleaching step in the same manner as the oil 74 to produce a hydrogenated oil 82. The oil 82 in turn is subjected to nitrogen deodorization treatment using the procedure previously described for aliquots 58, 60, and 62 to provide a hydrogenated and nitrogen-deodorized oil 84.

Various characteristics of the processed oils 66, 68, 72, 78 and 84 are set forth in the following table:

TABLE 3

| OIL | 66 | 68 | 72 | 78 | 84 |
|---|---|---|---|---|---|
| Red Color | 0.4 | 0.7 | 0.2 | 0.2 | 0.2 |
| Iodine Value | 129.2 | 129.4 | 129.0 | 128.7 | 125.1 |
| Conjugated Dienes | 4.64 | 3.20 | 3.44 | 3.55 | 8.98 |
| Conjugated Trienes | 1.02 | 1.02 | 1.15 | 0.98 | 1.01 |
| Total Tocopherol | 0.094 | 0.126 | 0.125 | 0.123 | 0.125 |

The conjugated diene and triene values are determined by AOCS method Cd 7-58. The tocopherol values are given in weight percent. The red color value is determined by an AOCS method using a Lovibond tintometer. Free fatty acid is expressed as oleic acid in weight percent, based on the weight of the oil. The peroxide value (P.V.) is given in milliequivalents of peroxide per 1000 grams of oil by AOCS method Cd 8-53.

Effects of various treatment parameters on the characteristics of the oil are set forth in Table 4:

TABLE 4

HYDROGEN TREATMENT OF REFINED SOYBEAN OIL IN-PROCESS ANALYSIS

| | TEST NUMBER | | | | | | |
|---|---|---|---|---|---|---|---|
| | 52 | 54 | 70 | 74 | 76 | 80 | 82 |
| Red color | 7.9 | 3.7 | 0.8 | 3.7 | 0.8 | 1.7 | 0.4 |
| & FFA | 0.02 | 0.02 | 0.03 | 0.03 | 0.03 | 0.03 | 0.03 |
| P.V. | 2.2 | 0.9 | 0.6 | 0.4 | 0.2 | Nil | Nil |
| Conjugated Dienes | 1.89 | 1.74 | 2.29 | 1.97 | 2.16 | 8.02 | 8.24 |
| Conjugated Trienes | 0.21 | 1.02 | 1.21 | 0.82 | 0.97 | 0.51 | 0.65 |
| Total Tocopherol | 0.133 | 0.132 | 0.128 | 0.138 | 0.131 | 0.132 | 0.127 |
| FA Dist. | | | | | | | |
| 18:0 | 3.8 | 3.7 | 3.7 | 3.7 | 3.8 | 3.5 | 3.5 |
| 18:1 | 23.8 | 23.9 | 24.0 | 24.5 | 24.5 | 27.4 | 27.4 |
| 18:2 | 54.8 | 55.2 | 55.2 | 54.7 | 54.4 | 53.3 | 53.3 |
| 18:3 | 6.8 | 6.6 | 6.7 | 6.5 | 6.7 | 5.9 | 5.8 |
| % Trans | 0 | 0 | 0 | 0 | 0 | 1.1 | 1.7 |
| I.V. | 131.5 | 131.2 | 131.0 | 131.0 | 130.9 | 127.4 | 128.5 |

A shelf life study is carried out on the various processed oils 66, 68, 72, 78, 84 involving the periodic analysis of flavor scores, peroxide values, and volatile analysis. A flavor score of 5 or more is considered acceptable. The results of this testing are set forth in the following Table 5:

TABLE 5

SHELF-LIFE STUDY
Flavor Scores (Peroxide Values) Volatiles - ppm

| | Test No. | | | | | | | | | | | | | | |
|---|---|---|---|---|---|---|---|---|---|---|---|---|---|---|---|
| Process | 66 Steam-Vac Deod. | | | 68 N2 Deod. | | | 72 Dbl Bleach N2 Deod. | | | 78 1 I.V. Drop H2 Treatment N2 Deod. | | | 84 4 I.V. Drop H2 Treatment N2 Deod. | | |
| Initial Score | 7.1 | (Nil) | 8.0 | 5.8 | (Nil) | 5.5 | 6.8 | (Nil) | 10.7 | 6.8 | (Nil) | 8.6 | 6.1 | (Nil) | 6.2 |
| Light | | | | | | | | | | | | | | | |
| Week 1 | 5.0 | (1.4) | 45.0 | 5.0 | (Nil) | 47.7 | 3.7 | (0.8) | 23.1 | 5.2 | (0.8) | 19.5 | 6.0 | (0.6) | 18.0 |
| Week 2 | 5.2 | | 41.5 | 5.3 | | 50.3 | 3.5 | | 26.8 | 5.0 | | 24.8 | 5.5 | | 20.4 |
| Week 3 | 3.3 | | 62.9 | 3.9 | | 66.6 | 3.1 | (1.8) | 37.6 | 3.1 | | 34.5 | 3.9 | | 29.5 |
| Week 4 | 3.4 | | 40.9 | 3.6 | | 83.9 | 3.3 | | 49.9 | 2.7 | | 42.3 | 4.1 | | 32.7 |
| Week 5 | — | | 33.6 | — | | 71.5 | — | | 44.2 | — | | 59.6 | — | | 37.4 |
| Dark | | | | | | | | | | | | | | | |
| Month 1 | 6.6 | (0.5) | 3.4 | 6.8 | (0.5) | 7.7 | 6.0 | (0.5) | 8.7 | 5.8 | (0.5) | 5.3 | 6.9 | (0.5) | 3.1 |
| Month 3 | 5.9 | (0.8) | 10.0 | 6.3 | (1.0) | 16.6 | 6.1 | (0.6) | 16.9 | 5.6 | (0.5) | 11.7 | 7.1 | (0.5) | 10.6 |
| Month 6 | 4.4 | (1.0) | 9.3 | 4.9 | (1.0) | 10.7 | 4.9 | (1.0) | 11.5 | 4.9 | (1.0) | 10.7 | 5.0 | (1.0) | 4.0 |

A number of additional runs are carried out as illustrated in FIG. 3. In this connection, a refined soybean oil 86 is subjected to bleaching to provide a refined and bleached soybean oil 88 by placing 3000 grams of the oil in a 5 liter round bottom flask and adding 0.6% filtrol 105 to the oil. The oil was heated to 190° F. under vacuum (25 mm Hg) and 300 rpm agitation and the temperature and agitation conditions are maintained at 190° F. for 15 minutes. The oil is subsequently filtered through a 10 gram bed of Filtercel on filter paper (Whatman #4). All bleached batches were combined into a common tank and kept at 45° F. until the next processing step. An aliquot of the oil is subjected to steam deodorization to provide a refined and bleached steam deodorized oil 90. Similarly, another aliquot of the refined and bleached oil 88 is subjected to hydrogen reduction treatment similar to that previously described in respect to FIG. 1. In this regard, 3000 grams of the oil is placed in a 5 liter deodorization flask with sparge tube, and 0.05 weight percent, based on the weight of the oil of a standard hydrogenation catalyst (20 weight percent nickel in liquid soybean oil) was added to the oil. The oil is sparged with substantially pure nitrogen at a rate of (2.1 liters per minute) while the oil was heated to 250° F., and at 250° F., the nitrogen sparge is discontinued and substantially pure hydrogen is sparged through the oil at atmospheric pressure at a rate of 7.0 liters per minute for 15 minutes. The hydrogen sparge is then discontinued and the nitrogen sparge resumed until the oil cooled to 225° F. and was subsequently filtered through a 10 gram bed of Filtercel over filter paper (Whatman #4). A number of hydrogen treatment batches are combined and placed in a 45° F. cooler, and this oil is subsequently bleached as previously described with respect to the bleaching of the oil 52 to provide oil 54. In this manner, a refined, double-bleached, hydrogen-reduced oil 94 is provided, different portions of which are subjected to steam or nitrogen deodorization treatment. In this regard, a portion of the oil 94 is subjected to steam deodorization conditions to provide a hydrogen-reduced, steam deodorized oil 96, while a second portion of the oil 94 is subjected to atmospheric pressure nitrogen deodorization as previously described in respect to oil samples 68, 72, 78, 84 to provide a hydrogen-reduced, nitrogen-deodorized oil 98.

A table of the analytical data (in weight percent where appropriate) for the runs of FIG. 3 is set forth as follows:

TABLE 6

| Process | Refined S/B | Bleach | Treat | 2nd Bleach | Steam Deod. | Steam Deod. | N2 Deod. |
|---|---|---|---|---|---|---|---|
| | Ref. # FIG. 3 | | | | | | |
| Step | 86 | 88 | 92 | 94 | 90 | 96 | 98 |
| Red Color | 7.7 | 1.7 | 1.4 | 0.8 | 0.6 | 0.3 | 0.4 |
| % FFA | 0.02 | 0.03 | 0.03 | 0.03 | 0.01 | 0.03 | 0.03 |
| P.V. | 9.1 | 2.1 | 0.3 | 0.3 | Nil | Nil | Nil |
| Conj. Dienes | 3.20 | 2.96 | 2.16 | 2.90 | 7.24 | 9.10 | 3.92 |
| Conj. Trienes | 0.30 | 1.48 | 1.14 | 1.30 | 1.25 | 1.15 | 1.24 |
| Total Tocopherol | 0.120 | 0.112 | 0.116 | 0.116 | 0.063 | 0.050 | 0.112 |
| FA Dist. | | | | | | | |
| 18:0 | 3.6 | 3.6 | 3.8 | 3.6 | 4.1 | 4.2 | 4.1 |
| 18:1 | 24.6 | 23.9 | 24.9 | 24.5 | 24.0 | 24.6 | 24.3 |
| 18:2 | 54.3 | 55.3 | 54.5 | 54.7 | 54.2 | 53.8 | 53.8 |
| 18:3 | 6.5 | 6.7 | 6.5 | 6.2 | 6.7 | 6.3 | 6.8 |
| % Trans | 0 | 0 | 0 | 0 | 4.6 | 6.4 | 1.2 |
| I.V. | 132.0 | 132.2 | 130.7 | 131.4 | 128.5 | 125.3 | 128.4 |

The oils 90, 96 and 98 are similarly utilized in the preparation of mayonnaise, french and thousand island dressing. Results of the shelf life study carried out by informal panels in respect to the processed products of FIG. 3 are set forth in the following table:

TABLE 7

SHELF-LIFE STUDY - INFORMAL FLAVOR PANELS
Flavor Score (P.V.) Volatiles [ppm]

| | Oil 90 | | | Oil 96 | | | Oil 98 | | |
|---|---|---|---|---|---|---|---|---|---|
| OIL | | | | | | | | | |
| Initial | 6.8 | (Nil) | 7.5 | 7.4 | (Nil) | 3.9 | 5.5 | (Nil) | 2.2 |
| 1 Week Lt | 4.9 | (Nil) | 6.9 | 5.8 | (Nil) | 3.7 | 4.6 | (Nil) | 2.6 |
| 2 Week Lt | 3.6 | (2.5) | 6.8 | 5.0 | (2.8) | 6.3 | 4.1 | (1.0) | 4.0 |
| 3 Week Lt | 3.2 | (2.8) | 9.0 | 4.2 | (3.8) | 9.4 | 3.7 | (1.5) | 14.1 |
| 4 Week Lt | 3.0 | (2.4) | 42.7 | 4.5 | (3.0) | 24.2 | 4.0 | (1.7) | 17.0 |
| 5 Week Lt | 3.0 | (3.0) | — | 4.0 | (3.4) | — | 3.0 | (2.0) | — |

TABLE 7-continued

SHELF-LIFE STUDY - INFORMAL FLAVOR PANELS
Flavor Score (P.V.) Volatiles [ppm]

| | Oil 90 | | | Oil 96 | | | Oil 98 | | |
|---|---|---|---|---|---|---|---|---|---|
| 1 Month Dk | 6.6 | (.6) | 10.7 | 6.5 | (1.0) | 12.4 | 5.0 | (.4) | 2.9 |
| 3 Month Dk | 6.1 | (1.2) | | 5.6 | (3.7) | | 5.3 | (.8) | |
| 8 Month Dk | 2.0 | (3.5) | | 2.0 | (3.8) | | 2.0 | (1.9) | |
| MAYONNAISE | | | | | | | | | |
| Initial | 6.8 | | | 6.1 | | | 5.7 | | |
| 2 Week Lt | 6.0 | | | 6.1 | | | 6.0 | | |
| 4 Week Lt | 5.6 | | | 6.5 | | | 5.3 | | |
| 10 Week Lt | 2.3 | | | 5.0 | | | 5.5 | | |
| 1 Month Dk | 6.0 | | | 6.4 | | | 5.0 | | |
| 3 Month Dk | 6.1 | | | 5.2 | | | 5.9 | | |
| 8 Month Dk | 5.0 | | | 5.0 | | | 5.0 | | |
| FRENCH DRESSING | | | | | | | | | |
| Initial | 7.5 | | | 7.9 | | | 7.5 | | |
| 2 Week Lt | 7.4 | | | 7.4 | | | 7.4 | | |
| 4 Week Lt | 6.3 | | | 6.5 | | | 6.0 | | |
| 10 Week Lt | 6.3 | | | 6.3 | | | 6.1 | | |
| 1 Month Dk | 7.2 | | | 7.3 | | | 7.0 | | |
| 3 Month Dk | 6.8 | | | 6.3 | | | 6.7 | | |
| 8 Month Dk | 6.0 | | | 5.0 | | | 5.0 | | |
| THOUSAND ISLAND DRESSING | | | | | | | | | |
| Initial | 7.3 | | | 7.1 | | | 7.3 | | |
| 2 Week Lt | 6.7 | | | 6.3 | | | 6.9 | | |
| 4 Week Lt | 5.7 | | | 5.3 | | | 6.3 | | |
| 10 Week Lt | 5.9 | | | 6.0 | | | 6.3 | | |
| 1 Month Dk | 7.5 | | | 6.7 | | | 6.7 | | |
| 3 Month Dk | 5.5 | | | 6.0 | | | 4.4 | | |
| 8 Month Dk | 5.0 | | | 5.0 | | | 5.0 | | |

Similarly, edible oils of animal origin may be deodorized by processing through the column of FIG. 1. For example, tallow may be deodorized by the countercurrent nitrogen treatment as described herein.

While the present invention has been particularly described with respect to certain specific embodiments, it will be appreciated that various modifications, adaptations and variations will become apparent based on the present disclosure and are intended to be within the spirit and scope of the appended claims.

What is claimed is:

1. A method for deodorizing an edible oil selected from the group consisting of edible vegetable oils and edible animal fats and mixtures thereof comprising the steps of deoxygenating the oil to provide a deoxygenated oil, heating the deoxygenated oil to a temperature in the range of from about 325° F. to about 550° F., continuously conducting the heated deoxygenated oil through a nitrogen, contacting zone having a solid surface to volume ratio of at least about 30 square feet of surface area per cubic foot of nitrogen contacting zone volume and continuously introducing substantially oxygen-free nitrogen having less than one part by weight per million of oxygen in a countercurrent manner through the heated oil in the nitrogen contacting zone at about atmospheric pressure conditions for a time period of at least about 5 minutes at an oil to gas weight to weight ratio in the range of from about 1.2 to about 4.5, and cooling the oil which has been conducted through the nitrogen contacting zone under oxygen excluding conditions to provide a deodorized vegetable oil.

2. A method in accordance with claim 1 wherein said nitrogen contacting zone is a column which has a length to diameter ratio of at least about 3, wherein said solid surface to volume ratio is at least about 500 square feet per cubic foot, and wherein said oil and nitrogen are introduced into the nitrogen contacting zone.

3. A method in accordance with claim 2 wherein said nitrogen contacting zone is a column which has a length to diameter ratio of said nitrogen contacting zone of at least about 20, wherein the nitrogen contacting zone contains a coiled metallic screen packing to increase the surface to volume ratio of the nitrogen contacting zone to a volume ratio of about 585 square feet per cubic foot and wherein the nitrogen pressure is periodically increased and decreased over a differential pressure in the range of from about 1 to about 100 psig.

4. A method in accordance with claim 1 wherein said edible oil is provided by deoxygenating an unsaturated edible vegetable oil, blending the oil with a hydrogenation catalyst, heating the oil to a temperature in the range of from about 100° F. to about 375° F., and contacting the oil and catalyst blend with hydrogen at a partial pressure of hydrogen of about one atmosphere or less to subject the oil to hydrogen reduction conditions without substantially reducing the unsaturated fatty triglyceride content of the oil such that the percentage reduction of the unsaturated bonds of the triglyceride components of the oil as a result of such hydrogen reduction conditions is 1.3 or less, and such that the oil does not substantially increase in trans acid content.

5. A method in accordance with claim 4 wherein said edible oil is soybean oil, and wherein said hydrogen reduction is carried out at substantially atmospheric pressure of hydrogen, and wherein the percentage reduction of the unsaturated bonds of the triglyceride components of the oil as a result of such hydrogen reduction conditions is in the range of from 0.3 to 1.3, and such that the oil does not substantially increase in trans acid content.

6. A method in accordance with claim 1 wherein said deoxygenated oil is provided by deoxygenating the oil, blending the oil with a hydrogenation catalyst, heating the oil to a temperature in the range of from about 100° F. to about 375° F., and contacting the oil and catalyst blend with hydrogen at substantially atmospheric pressure to subject the oil to hydrogen reduction conditions without substantially reducing the unsaturated fatty triglyceride content of the oil, and removing the catalyst.

7. A method in accordance with claim 1 wherein said deoxygenated oil is provided by deoxygenating the oil, blending the oil with a hydrogenation catalyst, heating the oil to a temperature in the range of from about 100° F. to about 375° F., contacting the oil and catalyst blend with hydrogen to subject the oil to hydrogen reduction conditions at a partial pressure of hydrogen of about one atmosphere or less without substantially reducing the unsaturated fatty triglyceride content of the oil, such that the percentage reduction of the unsaturated bonds of the triglyceride components of the oil as a result of such hydrogen reduction condition is 1.3 or less and such that the oil does not substantially increase in trans acid content, and separating the catalyst from the oil.

8. A method in accordance with claim 7 wherein said oil is refined and bleached natural soybean oil, wherein hydrogen is sparged through the oil, and wherein the percentage reduction of the unsaturated bonds of the triglyceride components of the oil as a result of such hydrogen reduction conditions is in the range of from 0.3 to 1.3 and wherein the reduction of Iodine Value of the oil as a result of said hydrogen reduction is 1 or less.

9. A method for deodorizing an edible oil selected from the group consisting of edible vegetable oils and edible animal fats and mixtures thereof comprising the steps of deoxygenating the oil to provide a deoxygenated oil, blending the oil with a hydrogenation catalyst, heating the deoxygenated oil to a temperature in the range of from about 100° F. to about 375° F., contacting the oil and catalyst blend with hydrogen to subject the oil to hydrogen reducing conditions at a partial pressure of hydrogen of about 1 atmosphere or less without substantially reducing the unsaturated fatty triglycerides contact of the oil such that the hydrogen reduction condition is 1.3 or less, continuously conducting the heated deoxygenated oil through a nitrogen contacting zone having a solid surface to volume ratio of at least about 30 square feet of surface area per cubic foot of nitrogen contacting zone volume and continuously introducing substantially oxygen-free nitrogen having less than one part by weight per million of oxygen in a countercurrent manner through the heated oil in the nitrogen contacting zone that is not under vacuum, for a time period of at least about 5 minutes, at an oil to gas weight to weight ratio in the range of from about 1.2 to about 4.5, and cooling the oil which has been conducted through the nitrogen contacting zone under oxygen excluding conditions to provide a deodorized vegetable oil.

* * * * *

UNITED STATES PATENT AND TRADEMARK OFFICE

CERTIFICATE OF CORRECTION

PATENT NO. : 5,091,116

DATED : February 25, 1992

INVENTOR(S) : Krishnamurthy et al.

It is certified that error appears in the above-identified patent and that said Letters Patent is hereby corrected as shown below:

On the Title page, item [56] References Cited: change the issue date of the Musher Patent from "8/1942" to --5/1942--.

Column 1, line 14, after "oil" insert a comma.
Column 4, line 21, change "ma" to --may--.
Column 6, line 62, change "exit" to --exits--.
Column 8, line 44, change "0.05%" to --0.05--.
Column 9, line 27, after "80" delete the comma.
Column 11, line 4, after "standard" insert --nickel--.

Signed and Sealed this

Fifteenth Day of June, 1993

*Attest:*

Michael K. Kirk

MICHAEL K. KIRK

*Attesting Officer*

*Acting Commissioner of Patents and Trademarks*